US011251572B2

(12) United States Patent
Xu et al.

(10) Patent No.: US 11,251,572 B2
(45) Date of Patent: Feb. 15, 2022

(54) ELECTRICAL CONNECTOR WITH GROUNDING FEATURES ON THE BOARD-SIDE WALL OF THE HOUSING

(71) Applicant: DONGGUAN LEADER PRECISION INDUSTRY CO., LTD, Dongguan (CN)

(72) Inventors: Hong-Qiang Xu, Dongguan (CN); Li-Jun Xu, Dongguan (CN); Gao-Fei He, Dongguan (CN); Meng-Jie Peng, Dongguan (CN)

(73) Assignee: Dongguan Leader Precision Industry Co., Ltd, Dongguan (CN)

( * ) Notice: Subject to any disclaimer, the term of this patent is extended or adjusted under 35 U.S.C. 154(b) by 0 days.

(21) Appl. No.: 17/022,333

(22) Filed: Sep. 16, 2020

(65) Prior Publication Data

US 2020/0412067 A1 Dec. 31, 2020

(30) Foreign Application Priority Data

Sep. 17, 2019 (CN) ..... 201910875274.8

(51) Int. Cl.
*H01R 13/6596* (2011.01)
*H01R 13/52* (2006.01)
(Continued)

(52) U.S. Cl.
CPC ..... *H01R 13/6596* (2013.01); *H01R 13/5219* (2013.01); *H01R 13/6598* (2013.01);
(Continued)

(58) Field of Classification Search
CPC ..... H01R 13/6596; H01R 13/5219; H01R 13/6598; H01R 24/60; H01R 13/6581; H01R 12/722; H01R 13/6591; H01R 13/52; H01R 13/658; H01R 12/727; H01R 2107/00; H01R 13/6594; H01R 12/724;
(Continued)

(56) References Cited

U.S. PATENT DOCUMENTS 9,401,568 B1 7/2016 Masuda et al.
2016/0149350 A1* 5/2016 Kao ..... H01R 24/60 439/607.05

FOREIGN PATENT DOCUMENTS

CN 206976715 U 2/2018
TW M564838 U 8/2018
TW M568517 U 10/2018

* cited by examiner

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

A connector includes an insulated member, a plurality of first conductive terminals, a plurality of second conductive terminals, a shielding shell, and a metal housing. The first conductive terminals are disposed on an upper surface of the insulated member and extending rearward. The second conductive terminals are disposed on a lower surface of the insulated member, extending rearward, and located below the first conductive terminals. The shielding shell is fitted over the insulated member, and the shielding shell has a plug end and a mounting end. The metal housing has a plurality of grounding structures, the metal housing is fitted over the mounting end of the shielding shell, and the grounding structures are completely located below the second conductive terminals.

11 Claims, 5 Drawing Sheets

(51) Int. Cl.

| | |
|---|---|
| ***H01R 13/6598*** | (2011.01) |
| ***H01R 24/60*** | (2011.01) |
| *H01R 13/6581* | (2011.01) |
| *H01R 12/72* | (2011.01) |
| *H01R 13/6591* | (2011.01) |
| *H01R 13/658* | (2011.01) |
| *H01R 13/502* | (2006.01) |
| *H01R 13/516* | (2006.01) |
| *H01R 107/00* | (2006.01) |
| *H01R 13/02* | (2006.01) |
| *H01R 13/648* | (2006.01) |
| *H01R 13/6594* | (2011.01) |

(52) U.S. Cl.

CPC ..... *H01R 24/60* (2013.01); *H01R 12/722* (2013.01); *H01R 12/724* (2013.01); *H01R 12/727* (2013.01); *H01R 13/02* (2013.01); *H01R 13/502* (2013.01); *H01R 13/516* (2013.01); *H01R 13/52* (2013.01); *H01R 13/648* (2013.01); *H01R 13/658* (2013.01); *H01R 13/6581* (2013.01); *H01R 13/6591* (2013.01); *H01R 13/6594* (2013.01); *H01R 2107/00* (2013.01)

(58) Field of Classification Search

CPC .... H01R 13/02; H01R 13/502; H01R 13/516; H01R 13/648

USPC ..... 439/660, 676

See application file for complete search history.

ELECTRICAL CONNECTOR WITH GROUNDING FEATURES ON THE BOARD-SIDE WALL OF THE HOUSING

CROSS-REFERENCE TO RELATED APPLICATION

This non-provisional application claims priority under 35 U.S.C. § 119(a) to Patent Application No. 201910875274.8 filed in China, P.R.C. on Sep. 17, 2019, the entire contents of which are hereby incorporated by reference.

BACKGROUND

Technical Field

The instant disclosure relates to an electrical connector, and in particular, to an electrical connector that can reduce the area of electronic circuit layout.

Related Art

With the developments of transmission interfaces, universal serial bus (USB) Type-C connectors with many advantages have emerged. The advantages of the USB Type-C connectors includes non-directional insertion, small size, support for high current charging, fast transmission speed, electromagnetic interference (EMI) shielding, enhanced radio frequency interference (RFI) mitigation features, and durability. More and more people are using the USB Type-C connectors, making the USB Type-C connectors gradually lead the market.

High-end USB Type-C connectors known to the inventor (s) often have dual in-line package pins (DIP pins) at the metal housing to achieve grounding. However, the method used by the connectors still occupies excess area of the circuit board, making the overall connector bulky.

SUMMARY

In view of the above problems, an embodiment of the instant disclosure provides a connector including an insulated member, a plurality of first conductive terminals, a plurality of second conductive terminals, a shielding shell, and a metal housing. The first conductive terminals are disposed on an upper surface of the insulated member and extending rearward. The second conductive terminals are disposed on a lower surface of the insulated member, extending rearward, and located below the first conductive terminals. The shielding shell is fitted over the insulated member, and the shielding shell has a plug end and a mounting end. The metal housing has a plurality of grounding structures. The metal housing is fitted over the mounting end of the shielding shell, and the grounding structures are completely located below the second conductive terminals, so that the overall volume of the connector can be reduced.

In one or some embodiments, each of the grounding structures includes an extending section and a mounting section, the extending section extends from a lower side of the second conductive terminals toward the second conductive terminals, the mounting section is connected to the extending section and is parallel to the second conductive terminals.

In one or some embodiments, the metal housing further includes an opening slot for the first conductive terminals and the second conductive terminals passing therethrough, and the ground structures are located at an inner side of the second conductive terminals and are adapted to be assembled to a circuit board. In this way, when the metal housing is installed in the shielding shell, the first conductive terminals, the second conductive terminals, and the mounting section of the grounding structures will be able to abut against the circuit board. Therefore, when the connector is assembled on the circuit board, the first conductive terminals, the second conductive terminals, and the ground structures can be assembled on the circuit board at the same time to simplify the assembling steps of the connector.

In one or some embodiments, the metal housing and the shielding shell are fixed together by laser welding.

In one or some embodiments, the metal housing includes a first top surface, a second top surface, a first side surface, a first bottom surface, a second bottom surface, a second side surface, and a third side surface. The first side surface is perpendicular to the first top surface and the second top surface, and is connected to the first top surface and the second top surface. The first bottom surface is substantially parallel to the first top surface. The second bottom surface is substantially parallel to the second top surface. The second side surface is perpendicular to the first bottom surface and the second bottom surface, and is connected to the first bottom surface and the second bottom surface. The third side surface is substantially parallel to the first side surface and the second side surface, and is connected to the second top surface and the second bottom surface to form a fastening portion. A left extension section and a right extension section of the shielding shell are fixed on the fastening portion, respectively.

In one or some embodiments, the metal housing includes an opening slot, the opening slot extends from the second side surface toward the third side surface along the second bottom surface, and the grounding structures extend from the second side surface toward a middle portion of the opening slot.

In one or some embodiments, two recessed grooves are respectively located at an upper side and a lower side of the shielding shell, and the two recessed grooves respectively accommodate the first top surface and the first bottom surface. Therefore, when the metal housing is fitted over the shielding shell, the metal housing can be accurately aligned to the shielding shell.

In one or some embodiments, the shielding shell includes a main body, a left extension section, and a right extension section. The left extension section is extending from the main body, fixed on the fastening portion, and abutting against the third side surface. The right extension section is extending from the main body with respect to the left extension section, fixed on the fastening portion, and abutting against the third side surface. Therefore, the fastening portion of the metal housing could be firmly combined with the shielding shell, so that the metal housing and the shielding shell would not be separated from each other upon encountering a slight impact.

In one or some embodiments, the shielding shell is an integrated structure, which makes the shielding shell have the waterproof effect.

In one or some embodiments, the insulated member includes a base, a first carrier board, and a second carrier board. The first carrier board passes through the base and extends out of the base, and a portion of each of the first conductive terminals is embedded in the first carrier board. A portion of each of the second conductive terminals is embedded in the second carrier board.

In one or some embodiments, the connector further includes a waterproof ring. The waterproof ring is fitted over an end portion of the shielding shell away from the metal housing.

In the following embodiments, specific features and advantages of the instant disclosure are described in detail. The content is sufficient to allow any person skilled in the art to understand the technical content of the instant disclosure and implement the technical content. In addition, any person skilled in the art can easily understand related objectives and advantages of the instant disclosure according to the content disclosed in this specification, claims, and drawings.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
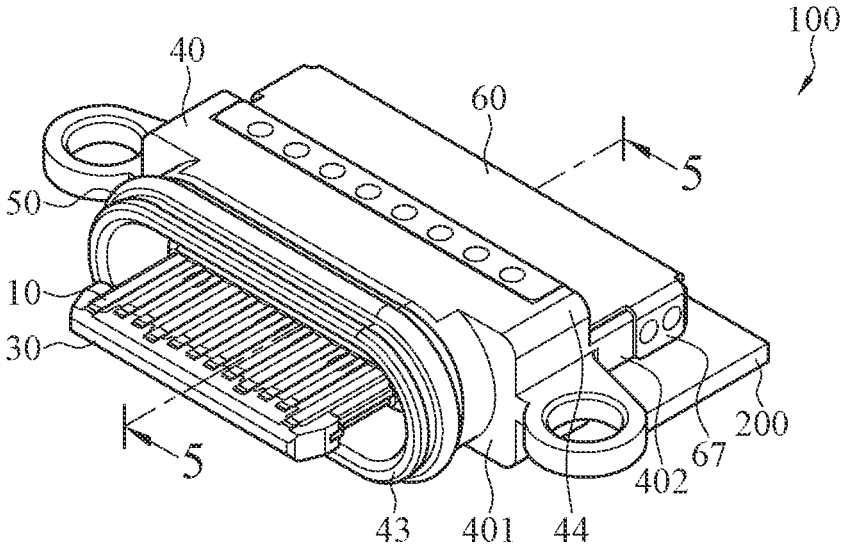
FIG. 1 is a perspective view of a connector according to an embodiment of the instant disclosure.
Figure 2:
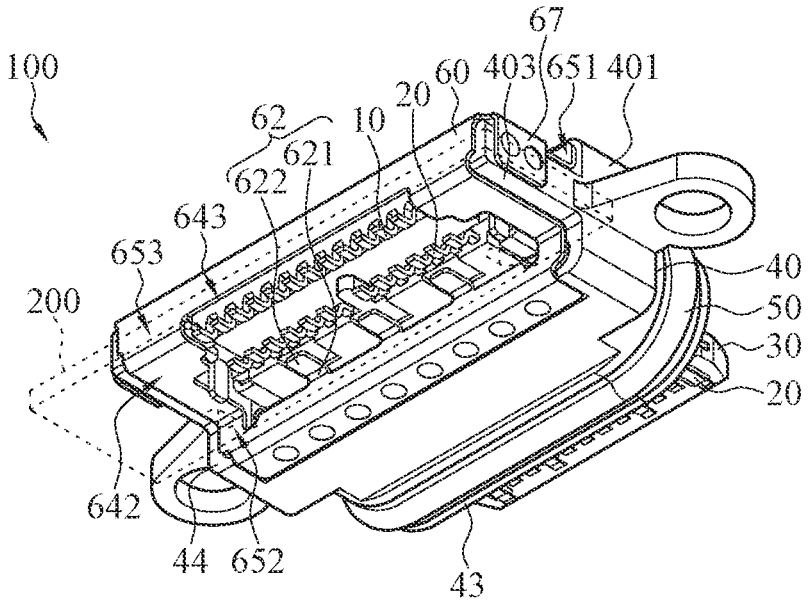
FIG. 2 is another perspective view of a connector according to an embodiment of the instant disclosure.

Referring to FIG. 1 and FIG. 2, FIG. 1 is a perspective view of a connector according to an embodiment of the instant disclosure, and FIG. 2 is another perspective view of a connector according to an embodiment of the instant disclosure. In this embodiment, the connector 100 is described by taking a USB Type-C connector as an example, but embodiments of the instant disclosure are not limited thereto. That is, the connector 100 of one or some embodiments of the instant disclosure can also be applied to other connectors, such as a right angle connector.

First Embodiment

Please refer to FIG. 1 and FIG. 2 again. The connector 100 includes an insulated member 30, a plurality of first conductive terminals 10, a plurality of second conductive terminals 20, a shielding shell 40, and a metal housing 60. The first conductive terminals 10 are disposed on the upper surface of the insulated member 30 and extend rearward. The second conductive terminals 20 are disposed on the lower surface of the insulated member 30 and extend rearward, and are located below the first conductive terminals 10. The shielding shell 40 is fitted over the insulated member 30, and has a plug end 43 and a mounting end 44.

Please refer to FIGS. 1 and 2, the metal housing 60 has a plurality of grounding structures 62, and after the metal housing 60 is fitted over a mounting end 44 of the shielding shell 40, the grounding structures 62 are completely located below the second conductive terminals 20. In this way, without separately providing the metal housing 60 and the grounding structures 62, the ground structure 62 can be located below the first conductive terminals 10 and the second conductive terminals 20, so that the overall volume of the connector 100 can be miniaturized and the aesthetics of the connector 100 can be improved.

Furthermore, the shielding shell 40 is fitted over the insulated member 30 and forms an accommodating space to receive the insulated member 30, the front ends of the first conductive terminals 10 and the front ends of the second conductive terminals 20. Here, the front ends of the first conductive terminals 10 and the second conductive terminals 20 are ends that can be plugged by other electronic devices. Conversely, rear ends of the first conductive terminals 10 and the second conductive terminals 20 are opposite to the front ends, and the rear ends of the first conductive terminals 10 and the second conductive terminals 20 are ends that can be connected to the circuit board 200.

It should be noted that, in one embodiment, the metal housing 60 is an integrated one-piece structure, and the one-piece structure can be made by, for example, stamping or by metal powder injection molding. The structure of the metal housing 60 will be described in detail below.

Figure 3:
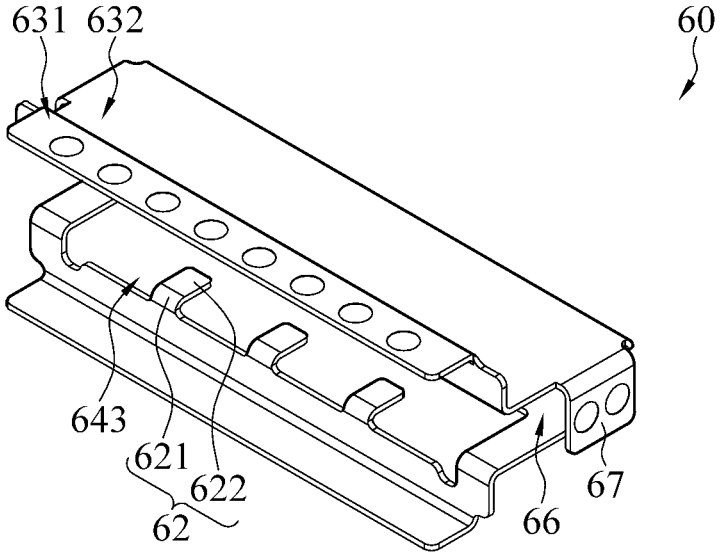
FIG. 3 is a perspective view of a metal housing of a connector according to an embodiment of the instant disclosure.
Figure 4:
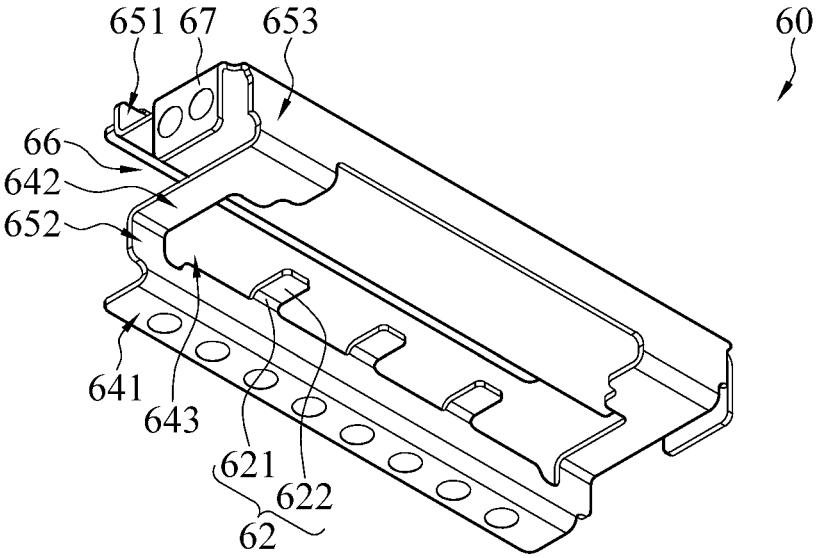
FIG. 4 is another perspective view of a metal housing of a connector according to an embodiment of the instant disclosure.
Figure 5:
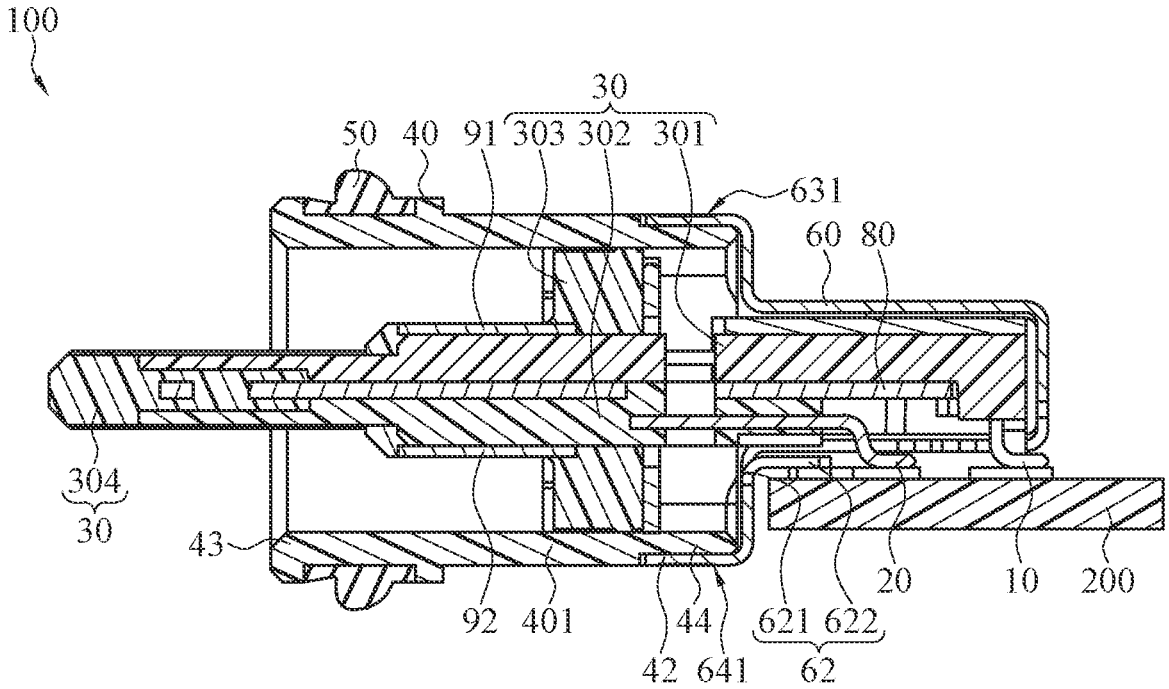
FIG. 5 is a cross-sectional view of a connector according to an embodiment of the instant disclosure along the line 5-5 shown in FIG. 1.

Referring to FIG. 3 to FIG. 5, FIG. 3 is a perspective view of a metal housing of a connector according to an embodiment of the instant disclosure, FIG. 4 is another perspective view of a metal housing of a connector according to an embodiment of the instant disclosure, and FIG. 5 is a cross-sectional view of a connector according to an embodiment of the instant disclosure along the line 5-5 shown in FIG. 1. In this embodiment, the metal housing 60 includes a first top surface 631, a second top surface 632, a first bottom surface 641, a second bottom surface 642, a first side surface 651, a second side surface 652, and a third side surface 653. The first side surface 651 is perpendicular to the first top surface 631 and the second top surface 632, and is connected to the first top surface 631 and the second top surface 632. In this embodiment, the first top surface 631 and the second top surface 632 are connected to two opposite sides of the first side surface 651, respectively. The first top surface 631 and the second top surface 632 are perpendicular to the first side surface 651, respectively, and extend in opposite directions. The third side surface 653 is connected to one side of the second top surface 632 opposite to the side of the second top surface 632 connected to the first side surface 651, and the third side surface 653 is perpendicular to the second top surface 632. Moreover, the third side surface 653 extends from the second top surface 632 in a direction opposite to the extension direction of the first side surface 651. That is, in this embodiment, the first top surface 631 and the second top surface 632 are substantially parallel, and the third side surface 653 and the first side surface 651 are substantially parallel but extend in different directions.

Next, the second bottom surface 642 is connected to one side of the third side surface 653 opposite to the side of the third side surface 653 connected to the second top surface 632, and the second bottom surface 642 is perpendicular to the third side surface 653. The second bottom surface 642 extends from the third side surface 653 in a direction the same as the extension direction of the second top surface 632. Therefore, the second bottom surface 642 is substantially parallel to the second top surface 632.

Next, the second side surface 652 is perpendicular to the first bottom surface 641 and the second bottom surface 642, and the second side surface 652 is connected to the first bottom surface 641 and the second bottom surface 642. In this embodiment, the second side surface 652 is connected to one side of the second bottom surface 642 opposite to the side of the second bottom surface 642 connected to the third side surface 653, and the second side surface 652 is perpendicular to the second bottom surface 642. The second side surface 652 extends from the second bottom surface 642 in a direction opposite to the extension direction of the third side surface 653. The first bottom surface 641 is connected to one side of the second side surface 652 opposite to the side of the second side surface 652 connected to the bottom surface 642, and the first bottom surface 641 is perpendicular to the second side surface 652. The first bottom surface 641 extends from the second side surface 652 toward a direction opposite to the extension direction of the bottom surface 642. That is, in this embodiment, the second side surface 652 and the third side surface 653 are substantially parallel to each other, and the second bottom surface 642 and the first bottom surface 641 are substantially parallel to each other but extend in opposite directions. Moreover, the first bottom surface 641 is substantially parallel to first top surface 631.

Refer to FIG. 3 to FIG. 5 again. The third side surface 653 is substantially parallel to the first side surface 651 and the second side surface 652. In this embodiment, the second bottom surface 642 and the second top surface 632 extend from the third side surface 653 in the same direction. The second bottom surface 642 and the second top surface 632 are substantially perpendicular to the third side surface 653. The first side surface 651 extends from the second top surface 632 in a direction opposite to the extension direction of the third side surface 653, and the first side surface 651 is substantially perpendicular to the second top surface 632. The second side surface 652 extends from the second bottom surface 642 in a direction opposite to the extension direction of the third side surface 653, and the second side surface 652 is substantially perpendicular to the second bottom surface 642. It can be seen from FIG. 3 and FIG. 4, when the metal housing 60 is viewed from the side, the shape of the metal housing 60 forms a laid U shape structure with an opening of the structure facing leftward, and end portions of the structure respectively extending upwardly and downwardly.

Refer to FIG. 2 and FIG. 5 again. In this embodiment, the metal housing 60 further comprises an opening slot 643, for the first conductive terminals 10 and the second conductive terminals 20 passing therethrough, so that the first conductive terminals 10 and the second conductive terminals 20 can be further connected to the circuit board 200. In this embodiment, the connection method may be, for example, soldering. The ground structures 62 are located at the inner side of the second conductive terminals 20 for being assembled to a circuit board 200. Specifically, in this embodiment, the opening slot 643 is a hollow portion of the metal housing 60 and the hollow portion extends from the second side surface 652 toward the third side surface 653 along the second bottom surface 642. The grounding structures 62 extend from the second side surface 652 toward a middle portion of the opening slot 643. Therefore, when the connector 100 is assembled on the circuit board 200, the first conductive terminals 10, the second conductive terminals 20, and the ground structures 62 can be assembled on the circuit board 200 at the same time thereby simplifying the assembling steps of the connector 100.

Refer to FIG. 4 and FIG. 5 again. In this embodiment, furthermore, each of the grounding structures 62 includes an extending section 621 and a mounting section 622, the extending section 621 extends from a lower side of the second conductive terminals 20 toward the second conductive terminals 20, and the mounting section 622 is connected to the extending section 621 and is parallel to the second conductive terminals 20. More specifically, in this embodiment, the second conductive terminals 20 are arranged along a horizontal plane parallel to the circuit board 200, and one end of each of the second conductive terminals 20 is bent to connect to the circuit board 200. After the metal housing 60 is fitted over the shielding shell 40, the mounting sections 622 of the ground structures 62 will be parallel to the second conductive terminals 20 and extend toward the end of the second conductive terminals 20 connected to the circuit board 200. That is, in this embodiment, the ground structures 62 are located at an inner side of the second conductive terminals 20. Therefore, after the metal housing 60 is fitted over the shielding shell 40, the mounting sections 622 will be able to abut against the upper surface of the circuit board 200. Therefore, when the connector 100 is assembled on the circuit board 200, the mounting sections 622 can abut against the upper surface of the circuit board 200 at the same time, thereby simplifying the manufacturing process and increasing the product yield. In this embodiment, the connection method of the second conductive terminals 20 and the circuit board 200, for example, soldering. However, embodiments of the instant disclosure are not limited thereto.

It can be seen from FIG. 5 that, the overall structure of the connector 100 is arranged as, from the top to the bottom, the first conductive terminals 10, the second conductive terminals 20, and the ground structures 62. The first conductive terminals 10, the second conductive terminals 20, and the ground structures 62 are sequentially arranged along the horizontal plane parallel to the circuit board 200 from outside to inside. In this way, the entire ground structures 62 will be located on a projection area of the connector 100 vertically projected onto circuit board 200. Therefore, the space of the circuit board 200 can be effectively used, and the overall size of the connector 100 can be greatly reduced.

Figure 6:
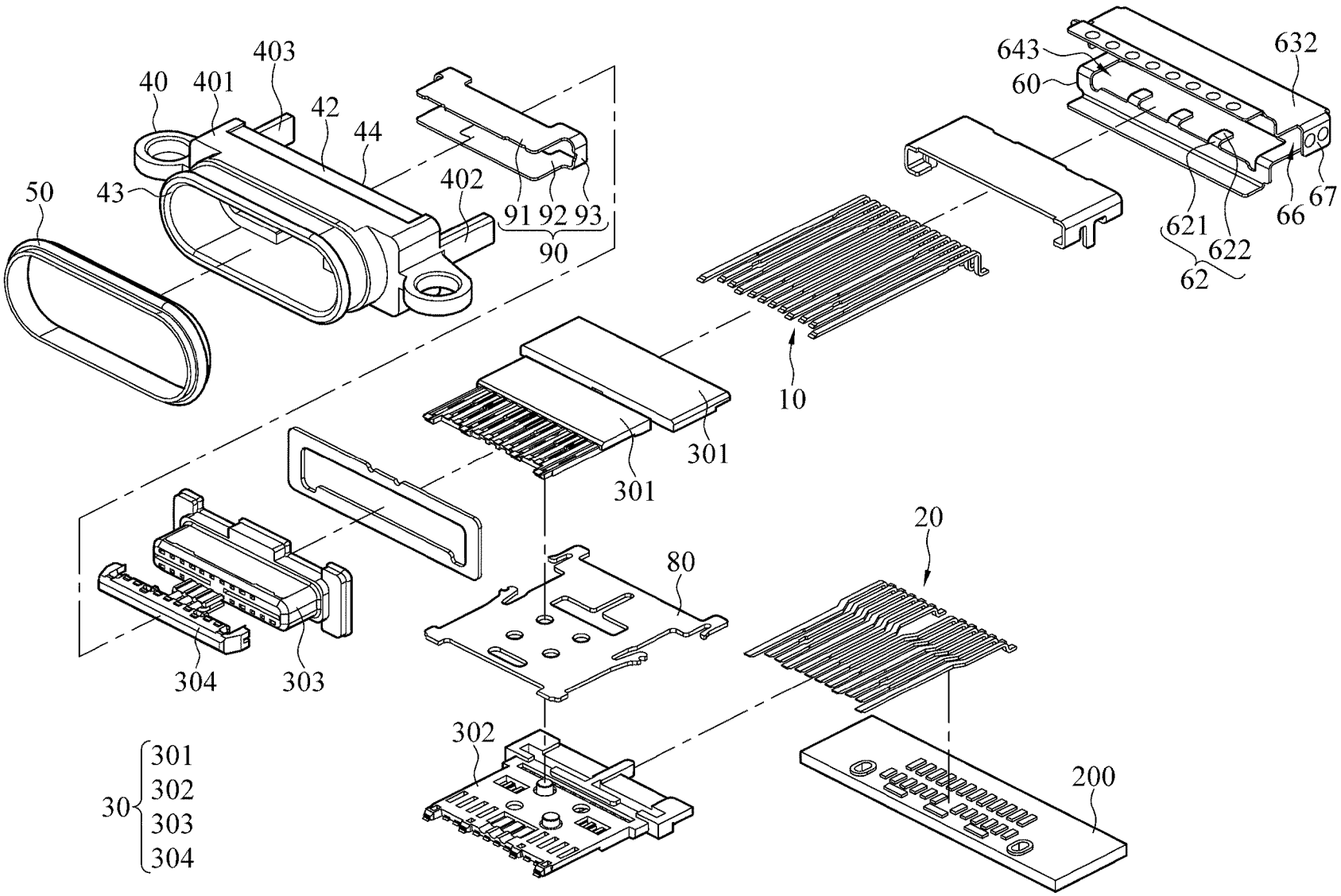
FIG. 6 is a exploded view of a connector according to an embodiment of the instant disclosure.

Refer to FIG. 2 and FIG. 6 again. FIG. 6 is an exploded view of a connector according to an embodiment of the instant disclosure. The second top surface 632 and the second bottom surface 642 of the metal housing 60 are respectively connected to opposite sides of the third side surface 653 and extend in the same direction, so that the overall structure of the metal housing 60 is similar to a laid U shape. In this embodiment, the laid U shape structure is defined as a fastening portion 66. In other words, in this embodiment, the third side surface 653 is substantially parallel to the first side surface 651 and the second side surface 652, and the third side surface 653 is connected to the second top surface 632 and the second bottom surface 642 to form the fastening portion 66. Furthermore, the metal housing 60 further includes two fixing sections 67. The two fixing sections 67 are respectively disposed on the fastening portion 66, and each of the two fixing sections 67 extends from the second top surface 632 toward the second bottom surface 642.

Refer to FIG. 2 and FIG. 6 again. The metal housing 60 and the shielding shell 40 are fixed together by laser welding. Specifically, in this embodiment, the shielding shell 40 has a main body 401, a left extension section 402, and a right extension section 403. The main body 401 is fixedly connected to and enclose the base 303 of the insulated member 30. The left extension section 402 extends from the main body 401, is fixed on the fastening portion 66, and abuts against the third side surface 653. The right extension section 403 extends from the main body 401 with respect to the left extension section 402, is fixed on the fastening portion 66, and abuts against the third side surface 653. By respectively fixing the two fixing sections 67 with the left extension section 402 and the right extension section 403 with laser welding, the metal housing 60 and the shielding shell 40 can be firmly connected together.

In this embodiment, the length of the left extension section 402 is equal to the length of the portion of the second top surface 632 between the first side surface 651 and the third side surface 653, and is equal to the length of the portion of the second bottom surface 642 between the second side surface 652 and the third side surface 653. Similarly, the length of the right extension section 403 is equal to the length of the portion of the second top surface 632 between the first side surface 651 and the third side surface 653, and is equal to the length of the portion of the second bottom surface 642 between the second side surface 652 and the third side surface 653.

The aforementioned matched structures can prevent dust in the air from contacting the first conductive terminals 10 and the second conductive terminals 20, thereby facilitating in extending the service life of the connector 100.

Refer to FIG. 5 and FIG. 6 again. In this embodiment, two recessed grooves 42 are respectively located at an upper side and a lower side of the shielding shell 40, and the two recessed grooves 42 respectively accommodate the first top surface 631 and the first bottom surface 641. Therefore, when the metal housing 60 is fitted over the shielding shell 40, the metal housing 60 can be accurately aligned to the shielding shell 40. In this embodiment, the metal housing 60 and the shielding shell 40 are fixed together by laser welding. Specifically, in this embodiment, after the two recessed grooves 42 respectively accommodate the first top surface 631 and the first bottom surface 641, the first top surface 631 and the first bottom surface 641 are fixed with the shielding shell 40 by laser welding. By fixing the aforementioned components with the laser welding method, the manufacturing time can be reduced, and the shielding shell 40 can be stably fixed with the metal housing 60.

In this embodiment, the shielding shell 40 is an integrated structure (also referred to as a seamless structure). The shielding shell 40 may be made of a suitable conductive material, and the shielding shell 40 is an integrated one-piece structure mainly made by metal powder injection molding process. In this way, the shielding shell 40 with an integrated structure can have waterproof performance. The manufacturing method of the aforementioned integrated structure can be adjusted according to the designer needs, and is not limited to the foregoing methods. In this embodiment, although manufacturing methods of the shielding shell 40 is described by using metal powder injection molding, other manufacturing methods are not excluded to make the shielding shell 40 having an integrated structure. Moreover, in other embodiments, the shielding shell 40 may also be made by a non-integral manufacturing method.

Figure 7:
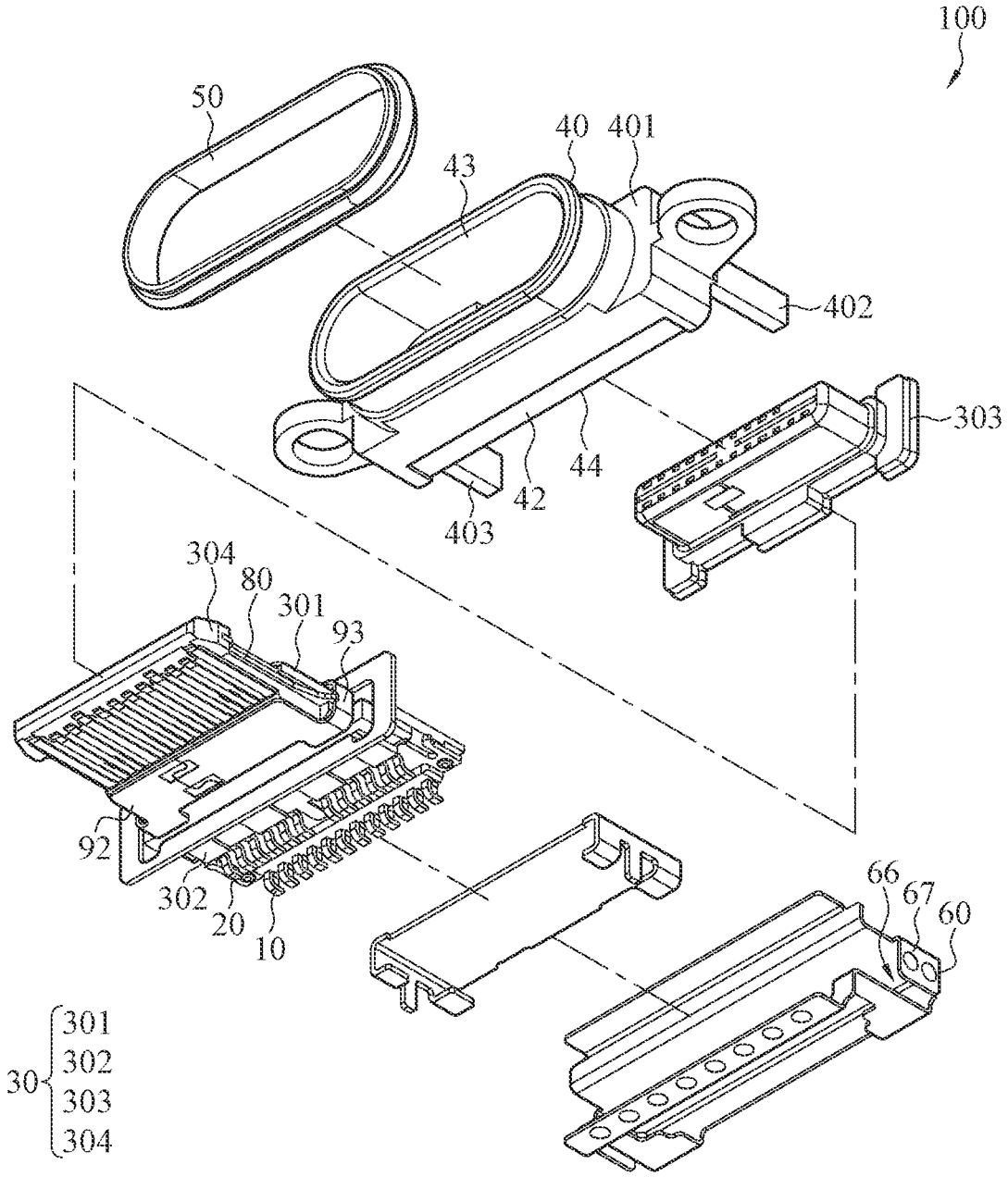
FIG. 7 is a partial exploded view of a connector according to an embodiment of the instant disclosure.

Referring to FIG. 6 and FIG. 7, FIG. 7 is a partial exploded view of a connector according to an embodiment of the instant disclosure. In this embodiment, the insulated member 30 includes a base 303, a first carrier board 301, and a second carrier board 302. The first carrier board 301 passes through the base 303 and extends out of the base 303, and a portion of each of the first conductive terminals 10 are embedded in the first carrier board 301. The second carrier board 302 passes through the base 303 and extends out of the base 303, and a portion of each of the second conductive terminals 20 is embedded in the second carrier board 302. Specifically, in this embodiment, the base 303 includes a channel, and the first carrier board 301 and the second carrier board 302 pass through and extend out of the base 303 through the channel, so that the first carrier board 301 and the second carrier board 302 are fixed on the base 303. The second carrier board 302 is located below the first carrier board 301. In this embodiment, although the insulated member 30 is described by assembling the first carrier board 301, the second carrier board 302, and the base 303 to each other, the structure of the insulated member 30 can also be adjusted according to the designer requirements, and is not limited to this embodiment. For example, the insulated member 30 may be a one-piece structure made by an integrated manufacturing process.

Moreover, the first conductive terminals 10 and the second terminals 20 described in the previous paragraphs are respectively and symmetrically disposed on the upper surface of the first carrier board 301 and the lower surface of the second carrier board 302 for mating with another connector, and the aforementioned symmetrical structure can provide a double-sided (bidirectional) plug-in function. In other words, if the first conductive terminals 10 is rotated by 180 degrees, the arrangement order of the ground terminal (Cable Ground), power terminal (Cable Bus Power) and transmission terminal (USB 2.0 Interface) of the rotated first conductive terminals 10 is the same as the arrangement order of those of the second conductive terminals 20, so that the connector 100 can provide a double-sided (bidirectional) plug-in function. It should be noted that, one ends of the first conductive terminals 10 and the second conductive terminals 20 for connecting to the circuit board 200 are SMT pins (Surface Mount Technology) extending in the horizontal direction. In this embodiment, for example, the connection method for connecting the first conductive terminals 10 and the second conductive terminals 20 on the circuit board 200 is soldering. However, embodiments of the instant disclosure are not limited thereto, and the method for connecting the first conductive terminals 10 and the second conductive terminals 20 on the circuit board 200 can be adjusted according to the design requirements.

Please refer to FIG. 6 and FIG. 7. Moreover, in this embodiment, the insulated member 30 further includes a retaining base 304, and the retaining base 304 is disposed at an end of the insulated member 30 adjacent to the plug end 43. Ends of the first conductive terminals 10 far from the circuit board 200 are embedded in the retaining base 304. Ends of the second conductive terminals 20 far from the circuit board 200 are embedded in the retaining base 304. In this way, the first conductive terminals 10 at the upper part of the retaining base 304 and the second conductive terminals 20 at the lower part of the retaining base 304 can be prevented from being too close to cause the short circuit condition.

Refer to FIG. 6 and FIG. 7 again. The connector 100 in this embodiment, further comprises a waterproof ring 50, and the waterproof ring 50 is fitted over an end portion of the shielding shell 40 away from the metal housing 60; in other words, the plug end 43. Specifically, in this embodiment, the plug end 43 of the shielding shell 40 has a stopping structure, and the waterproof ring 50 is fitted over and arranged around the shielding shell 40, and the waterproof ring 50 abuts against the stopping structure to prevent the waterproof ring 50 from being detached off the plug end 43 of the connector 100. In this embodiment, the waterproof ring 50 is one-piece structure. In some embodiment, the waterproof ring 50 could be fitted over the shielding shell 40 after being molded, or can be directly liquid-formed on the outer surface of the shielding shell 40. However, embodiments of the instant disclosure are not limited thereto, and the configuration of the waterproof ring 50 could be adjusted according to the designer requirements in actual applications. Because of the configuration of the waterproof ring 50 and the shielding shell 40 formed as an integrated one-piece structure, the waterproof performance of the connector 100 can be improved.

In this embodiment, it can be seen from FIG. 6 and FIG. 7, the connector 100 further includes an intermediate shielding sheet 80, the intermediate shielding sheet 80 pass through the insulated member 30 and is held between the first carrier board 301 and the second carrier board 302. In other words, in this embodiment, the first carrier board 301 is disposed on the upper surface of the intermediate shielding sheet 80, and the second carrier board 302 is disposed on the lower surface of the intermediate shielding sheet 80.

Please refer to FIG. 6 and FIG. 7. In this embodiment, the connector 100 further includes an inner shielding sheet 90. The inner shielding sheet 90 includes an upper portion 91, a lower portion 92 and two connecting portions 93. The two connecting portions 93 are connected to the upper portion 91 and the lower portion 92 to form a surrounding structure, and the surrounding structure is fitted over the first carrier board 301 and the second carrier board 302. The upper portion 91 passes through the base 303 and is attached to the upper surface of the first carrier board 301, the lower portion 92 passes through the base 303 and is attached to the lower surface of the second carrier board 302. In this way, the first carrier board 301 and the second carrier board 302 can be in contact with each other closely without separation, thereby increasing the stability of the overall structure of the insulated member 30.

Second Embodiment

Refer to FIG. 2 and FIG. 6 again. In this embodiment, elements which are the same as the elements in the first embodiment are marked with reference numerals the same as the reference numerals in the first embodiment, and same components and structures are not described repeatedly herein. The difference between this embodiment and the first embodiment lies in that, the metal housing 60 and the shielding shell 40 are fixed together by laser welding in the first embodiment; while in this embodiment, the metal housing 60 and the shielding shell 40 are connected to the each other by engaging. Specifically, in this embodiment, the fastening portion 66 of the metal housing 60 can be mated with the left extension section 402 and the right extension section 403 of the shielding shell 40. Therefore, by using the aforementioned matching structure, the shielding shell 40 can be fixed to the metal housing 60, and the shielding shell 40 and the metal housing do not separate from each other upon encountering a slight impact.

In conclusion, the connector 100 disclosed in one or some embodiments of the instant disclosure, by disposing the metal housing 60, the ground structures 62 can be located on a projection area of the connector 100 vertically projected onto the circuit board 200. Therefore, the space of the circuit board 200 can be effectively used, the overall size of the connector 100 can be greatly reduced, and the aesthetics of the connector 100 can be improved. Moreover, because the ground structures 62 and the metal housing 60 are formed as an integrated one-piece structure, when fixing the metal housing 60 to the connector 100, the grounding structures 62 can be located below the second conductive terminals 20 at the same time without additional steps, thereby simplifying the assembling steps of the connector 100. Furthermore, by using laser welding to connect the metal housing 60 and the shielding shell 40, or by configuring the fastening portion 66 of the metal housing 60, the metal housing 60 can be firmly combined with shielding shell 40.

Although the instant disclosure has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector, comprising:

an insulated member;

a plurality of first conductive terminals disposed on an upper surface of the insulated member and extending rearward;

a plurality of second conductive terminals disposed on a lower surface of the insulated member, extending rearward, and located below the first conductive terminals;

a shielding shell fitted over the insulated member, wherein the shielding shell has a plug end and a mounting end; and a metal housing having a plurality of grounding structures, wherein the metal housing is fitted over the mounting end of the shielding shell, and the grounding structures are completely located below the second conductive terminals.

2. The connector according to claim 1, wherein each of the grounding structures comprises an extending section and a mounting section, the extending section extends from a lower side of the second conductive terminals toward the second conductive terminals, and the mounting section is connected to the extending section and is parallel to the second conductive terminals.

3. The connector according to claim 1, wherein the metal housing further comprises an opening slot for the first conductive terminals and the second conductive terminals passing therethrough, and the ground structures are located at an inner side of the second conductive terminals and are adapted to be assembled to a circuit board.

4. The connector according to claim 1, wherein the metal housing and the shielding shell are fixed together by laser welding.

5. The connector according to claim 1, wherein the metal housing comprises:

a first top surface;

a second top surface;

a first side surface perpendicular to the first top surface and the second top surface, and is connected to the first top surface and the second top surface;

a first bottom surface substantially parallel to the first top surface;

a second bottom surface substantially parallel to the second top surface;

a second side surface perpendicular to the first bottom surface and the second bottom surface, and is connected to the first bottom surface and the second bottom surface; and a third side surface substantially parallel to the first side surface and the second side surface, and is connected to the second top surface and the second bottom surface to form a fastening portion.

6. The connector according to claim 5, wherein the metal housing comprises an opening slot, the opening slot extends from the second side surface toward the third side surface along the second bottom surface, and the grounding structures extend from the second side surface toward a middle portion of the opening slot.

7. The connector according to claim 5, wherein two recessed grooves are respectively located at an upper side and a lower side of the shielding shell, and the two recessed grooves respectively accommodate the first top surface and the first bottom surface.

8. The connector according to claim 5, wherein the shielding shell comprises:

a main body;

a left extension section extending from the main body, fixed on the fastening portion, and abutting against the third side surface; and a right extension section extending from the main body with respect to the left extension section, fixed on the fastening portion, and abutting against the third side surface.

9. The connector according to claim 1, wherein the shielding shell is an integrated structure made by metal powder injection molding.

10. The connector according to claim 1, wherein the insulated member comprises:

a base;

a first carrier board passing through the base and extending out of the base, wherein a portion of each of the first conductive terminals are embedded in the first carrier board; and a second carrier board, wherein a portion of each of the second conductive terminals are embedded in the second carrier board.

11. The connector according to claim 1, further comprising a waterproof ring, wherein the waterproof ring is fitted over an end portion of the shielding shell away from the metal housing.

* * * * *